United States Patent [19]

Satoh

[11] 4,124,101

[45] Nov. 7, 1978

[54] ELEVATOR SPEED CONTROL APPARATUS

[75] Inventor: Tsuyoshi Satoh, Inazawa, Japan

[73] Assignee: Mitsubishi Denki Kabushiki Kaisha, Tokyo, Japan

[21] Appl. No.: 736,818

[22] Filed: Oct. 29, 1976

[30] Foreign Application Priority Data

Oct. 29, 1975 [JP] Japan ..... 50-130257

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,350,612 | 10/1967 | Hansen et al. | 187/29 X |
| 3,523,232 | 8/1970 | Hall et al. | 187/29 |
| 3,774,729 | 11/1973 | Winkler | 187/29 |
| 3,783,974 | 1/1974 | Gilbert et al. | 187/29 |

*Primary Examiner*—Robert K. Schaefer
*Assistant Examiner*—W. E. Duncanson, Jr.
*Attorney, Agent, or Firm*—Oblon, Fisher, Spivak, McClelland & Maier

[57] ABSTRACT

An elevator speed control apparatus is disclosed comprising: an ideal velocity generator for generating a velocity ideal for the cage to travel the distance to a floor the cage is to land; a velocity detector for detecting the velocity of the cage in motion; a comparator for comparing the actual cage velocity data supplied from the velocity detector with the ideal velocity data supplied from the ideal velocity generator; an acceleration setting device for setting an acceleration for the cage; an acceleration modifying device operated by the output of the comparator, for modifying the acceleration data supplied from the acceleration modifying device; a command velocity pattern generator for integrating with time the acceleration data supplied from the acceleration modifying device and thus generating a command velocity pattern; and a motor driving device for controlling the cage hoist driving motor according to the command velocity pattern; wherein an ideal cage velocity is maintained by modifying the acceleration data according to the output of the comparator.

4 Claims, 6 Drawing Figures

FIG. 1 (a)
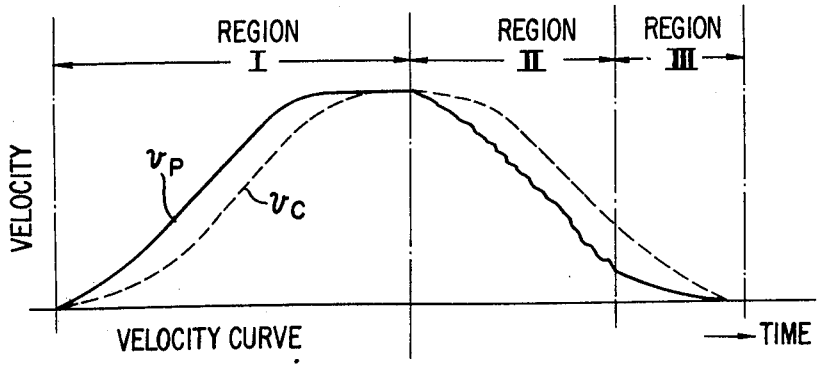
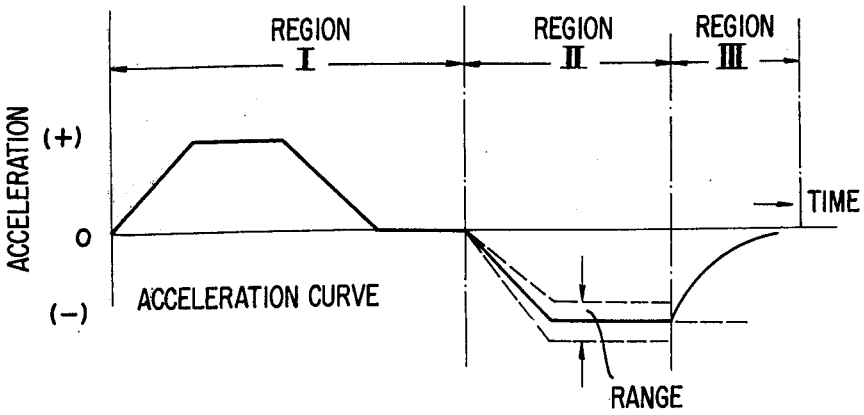
FIG. 1 (b)

ELEVATOR SPEED CONTROL APPARATUS

BACKGROUND OF THE INVENTION

The present invention relates to elevator speed control apparatus.

An elevator is driven essentially by a mechanical system, a rope system and a control system, the mechanical system comprising a motor and a traction machine. The elevator in operation is subjected to various disturbances among which are loss caused in the mechanical system, delay in the control system and variations in the damping constant of the control system ascribed to the length of the rope, with the result that the cage does not always accurately travel the distance determined by an input velocity pattern. This has made it difficult to control elevator acceleration and deceleration, resulting in inaccuracy in landing the cage into position. Nevertheless improvements in this technique have been hampered by the fact that the acceleration and deceleration cannot largely be changed due to limitations in connection with passenger comfort and traction between the traction machine and the rope.

SUMMARY OF THE INVENTION

It is therefore an object of the present invention to provide an elevator speed control apparatus capable of driving the cage according to a velocity pattern conforming to a given velocity curve.

BRIEF DESCRIPTION OF THE DRAWING

FIGS. 1(*a*) and 1(*b*) are graphic diagrams showing elevator velocity curves and acceleration curves.

DETAILED DESCRIPTION OF THE INVENTION

With reference to FIGS. 1(*a*) and 1(*b*), there are shown elevator velocity curves and acceleration curves, wherein the symbol Vp indicates by the solid line a command velocity pattern supplied as an input to the motor control device; and Vc, by the broken line a velocity curve drawn by the cage in operation. The command velocity pattern is divided into regions I, II and III. The region III is used only in need of a velocity pattern supplied from a position-velocity converter which is normally installed in the hatchway and operated immediately before the cage is stopped. In the region I, a command velocity pattern is generated on a time basis, and in the region II, a command velocity pattern is generated to permit the cage to run at a velocity according to the distance to the floor it is to land.

In an elevator system, the cage is driven to start running toward a floor where a call is generated. However, the cage is supposed to stop on its way to the called floor in response to another call from another floor. This is why the form of a command velocity pattern should not be fixed for the cage at its start toward a floor where a call is generated. As a solution to the problem, a command velocity pattern is generated on a time basis in the region I until the floor the cage is to reach is finally determined, and the region I is switched to the region II where a command velocity pattern is generated to permit the cage to run at a velocity according to the distance to the floor it is to reach. In this operation an abrupt change in the command velocity pattern will result in an abrupt change in the acceleration felt by passengers in the cage, which can seriously impair passenger comfort. It is therefore desirable that the command velocity pattern be generated so that the cage is accelerated to a velocity appropriate for the distance to the floor by controlling the change in the acceleration to a value within the range indicated by the dotted line in FIG. 1(*b*).

Figure 2:
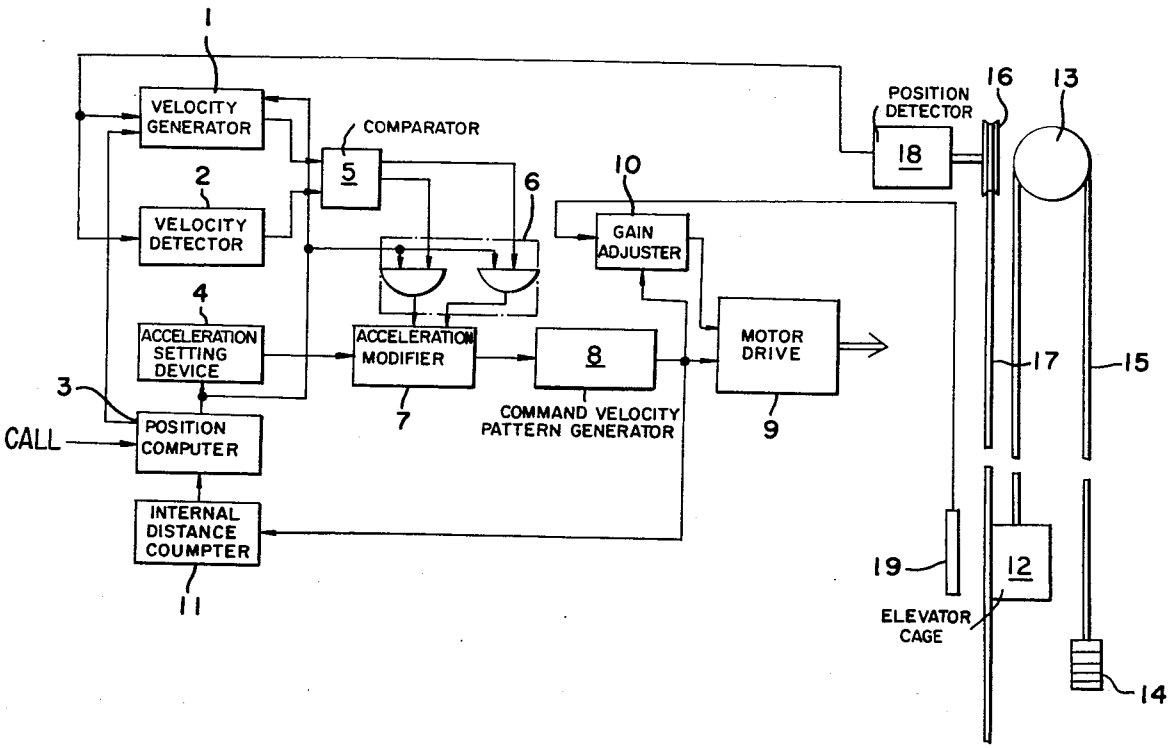
FIG. 2 is a block diagram showing an elevator speed control apparatus of one embodiment of the invention.

Referring to FIG. 2, there is shown in block form an elevator speed control apparatus of the invention, which comprises: an ideal velocity generator 1 for generating an ideal cage velocity according to the distance to the floor it is to reach; a velocity detector 2 for detecting the velocity of the cage for a distance it has traveled for a given period of time; a position computer 3 for determining the distance to be traveled by the cage, selecting the necessary acceleration, and switching the acceleration region according to a call or other data generated; an acceleration setting device 4 for setting an acceleration according to the acceleration selection signal from the position computer 3; a comparator 5; an AND circuit 6; an acceleration modifying device 7 for modifying the acceleration at a given ratio; a command velocity pattern generator 8 for generating a command velocity pattern by integrating the acceleration data; a motor driving device 9; a gain adjusting device 10 for matching between two pattern levels when the region II is switched to the region III; an internal distance computer 11 for integrating a given command velocity pattern and thus computing the distance traveled by the cage at the command velocity; an elevator cage 12; a traction machine 13; a counterweight 14; a rope 15 with one end fastened to the cage by way of the traction machine 13, and the other end fastened to the counterweight 14; a governor sheave 16; a governor rope 17 threaded endlessly on the governor sheave 16 and a pulley (not shown), with part fastened to the cage 12; a position detector 18 for converting the rotating angle of the governor sheave 16 into the distance traveled by the cage 12; and a position-velocity converter (19) installed in the hatchway for enabling the cage 12 to land in position with accuracy.

When a call is generated, the position computer 3 judges the acceleration region used and selects the acceleration. The resultant signal is supplied to the acceleration setting device 4 and the AND circuit 6. The position computer 3 computes also the distance to be traveled by the cage in response to the call and further computes the position where the cage can be stopped on the way. Upon receiving the acceleration selection signal from the position computer 3, the acceleration setting device 4 selects the acceleration designated by the acceleration selection signal. The resultant signal is supplied to the acceleration modifying device 7. Suppose the AND circuit 6 closes its gate in the state of region I. Then this gate remains closed as long as the signal of region I is supplied from the position computer 3 to the AND circuit 6. In this state, the acceleration modifying device 7 does not function and the acceleration signal from the acceleration setting device 4 is supplied to the command velocity pattern generator 8 in which the signal is integrated with time. This command velocity pattern is supplied to the motor driving device 9 whereby the motor (not shown) is driven to operate the hoist 13, thus moving the cage 12. Moving the cage 12 causes the governor sheave 16 to rotate via the governor rope 17. As the sheave 16 rotates, the position detector 18 detects the distance traveled by the cage 12.

The distance computer 11 integrates with time the command velocity pattern supplied from the command velocity pattern generator 8, thereby computing the theorectical distance to be traveled by the cage. The position computer 3 determines the final floor the cage will stop at, according to the call and the computed theoretical distance, thus generating a signal for switching the region I to the region II. The ideal velocity generator 1 computes at switching from the region I to II the difference between the distance actually traveled by the cage in the region I and the distance to be traveled by the cage to reach the final floor and modifies the cage velocity appropriate for the rest of the distance it is to travel. The modified cage velocity is supplied as a reference value to the comparator 5. The velocity detector 2 detects the actual cage velocity in reference to the time for the cage to travel a given distance or to the distance traveled by the cage for a given time and supplies the detected result to the comparator 5. The comparator 5 compares the data from the velocity detector 2 with the reference value from the ideal velocity generator 1. The compared result is supplied to the AND circuit 6, which passes the output of the comparator 5 to the velocity modifying device 7 through its gate opened by the signal of region II supplied from the position computer 3. The acceleration is adjusted according as the data supplied to the comparator 5 from the velocity detector 2 is larger or smaller than the reference value. This adjustment is done either intermittently or continuously. The modified acceleration is integrated with time by the command velocity pattern generator 8 whereby a command velocity pattern appropriate for the distance traveled by the cage in the region II is obtained.

In the event of operation in the region III, an output signal from the position-velocity converter 19 is supplied to the gain adjusting device 10, in which the output of the position-velocity converter 19 is matched with the level of the command velocity pattern present at switching from the region II to III, permitting the command velocity pattern to be smoothly switched to the output of the position-velocity converter 19 at the transition of the region II to III.

Figure 3:
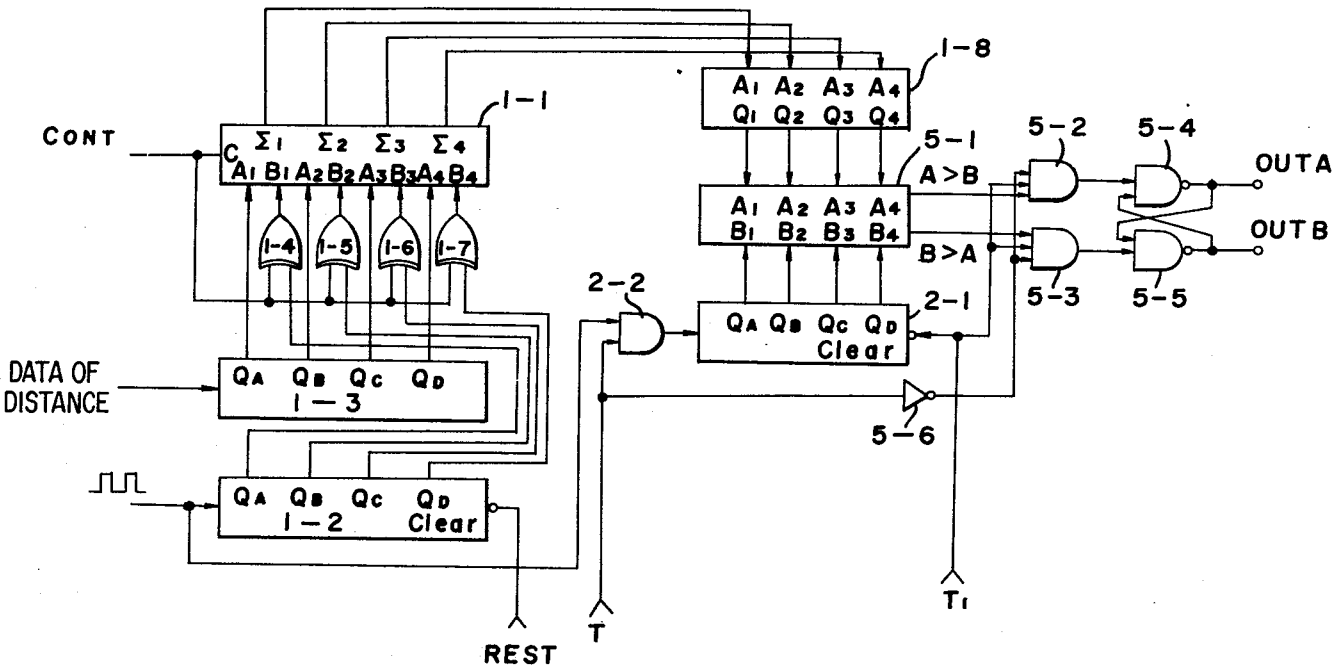
FIGS. 3 to 5 are circuit diagrams showing details of the embodiment shown in FIG. 2.

The invention will be described in more details by referring to FIGS. 2 and 3. For explanatory simplicity, assume the high level (H level) corresponds to "1" and the low level (L level) to "0" in terms of logics, and data treated are of 4-bit binary number. In FIG. 3, there are shown a 4-bit binary full adder 1—1 constituted, for example, of SN7483 of Texas Instruments; a binary counter 1-2 constituted, for example, of SN7493 of Texas Instruments; and a parallel-out serial shift register 1-3 constituted, for example, of SN74164 of Texas Instruments. Also shown are exclusive OR gates 1-4 to 1-7 of known type. The binary counter 1-2 counts the pulse output generated by the position detector 18 corresponding to a given distance traveled by the cage as a result of the rotation of the governor sheave 16. The counted result appears at outputs $Q_A$ to $Q_D$ (where $Q_A = 2^0$, $Q_B = 2^1$, $Q_C = 2^2$, $Q_D = 2^3$). The output of the binary counter 1-2 indirectly indicates the distance the cage has so far traveled. At the instant the need for decelerating the cage occurs as a result of a call to respond to, that is, in the state of region II, a data on the distance to be traveled by the cage from the starting floor (or a reference floor) to the stopping floor is supplied from the position computer 3 to the parallel-out seriel shift register 1-3. The circuit formed of the 4-bit binary full adder 1—1 and the exclusive OR gates 1-4 to 1-7 has the function of a parallel binary adder/subtractor, capable of subtracting or adding operation according to the high or low of a control signal CONT. When the subtracting mode is in effect, i.e., the control signal CONT is in the state "1", one side of inputs of the exclusive OR gates 1-4 to 1-7 stand at "1", causing the gates 1-4 to 1-7 to generate outputs which are the inverted inputs of the other side, that is, the complements of values expressed in binary version. As well-known, subtraction in binary logical operation is performed in such manner that the complement of the subtrahend is added to the minuend in binary notation and then 1 is added to the sum. Hence, with the subtraction mode designated, "1" can be added thereto by causing the input terminal C of the binary full adder 1—1 to stand at "1".

In the state of region II, the parallel-out serial shift register 1-3 has a data on the distance to be traveled by the cage to its stopping floor, and the binary counter 1-2 has a data on the distance the cage has so far run. Subtracting the data in the binary counter 1-2 from that in the parallel-out serial shift register 1-3 gives the distance the cage 12 is supposed to travel till it is to stop. Data on the rest of the distance to be traveled by the cage is present in binary virsion at output terminals $\Sigma_1$ to $\Sigma_4$ of the 4-bit binary full adder 1—1.

A read-only memory 1-8 is provided for storing an ideal cage velocity as a function of distance. This memory is constituted, for example, of IM5600 of Intersil. With addresses $A_1$ to $A_4$ used, addressed data are available at $Q_1$ to $Q_4$. The address input to the memory 1-8 is the output of the 4-bit binary full adder 1—1, indicating the rest of the distance to be traveled by the cage. The output of the read-only memory 1-8 indicates on ideal velocity at which the cage runs the rest of the distance to the floor it is to reach.

The elevator speed control apparatus further comprises a binary counter 2-1 similar to the foregoing binary counter 1-2, and a 2-input AND gate 2—2 having one input supplied with a pulse signal from the position detector 18, and the other input supplied with a timing signal T from a timing generator (not shown). When the timing signal T is in the state "1", the 2-input AND gate 2—2 opens its gate to pass the pulse input from the position detector 18 to the binary counter 2-1. The binary counter 2-1 counts the input pulse while the AND gate 2—2 remains opened. When the timing signal T turns into "0", the 2-input AND gate is closed to hamper the input pulse from being passed to the binary counter 2-1. In this state, the binary counter 2-1 is unable to further count the input pulse, causing the binary parallel outputs $Q_A$ to $Q_D$ of the binary counter 2-1 to be inoperative. Thus the output of the binary counter 2-1 stands for the distance traveled by the cage while the timing signal T is in the state "1", that is, the output of the counter 2-1 approximately indicates the velocity of the cage running while the timing signal T is in the state "1". To maintain high accuracy of approximation in the operation where the cage velocity is varying, the distance traveled by the cage needs to be reduced and the period for which the timing signal T is in the state "1" needs to be narrowed.

The timing signal $T_1$ turns into "0" for a very short period immediately before the timing signal T takes on the state "1". This "0" signal goes to the clear terminal of the binary counter 2-1, thereby clearing the data in the counter 2-1. As a result of this operation, the velocity of the cage in motion while the timing signal T is in the state "1" is accurately determined.

There is provided a 4-bit magnitude comparator 5-1 which takes comparison between its A-input (binary data supplied to inputs $A_1$ to $A_4$) and its B-input (binary data supplied to inputs $B_1$ to $B_4$) and generates the compared result A > B, A = B or A < B. The comparator 5-1 is constituted, for example, of SN7485 of Texas Instruments. For explanatory simplicity, the signal $A = B$ is not shown in FIG. 3. Further provided are 3-input NAND gates 5-2 and 5-3, and 2-input NAND gates 5-4 and 5-5 which form a known set-reset flip-flop circuit. An inverter circuit 5-6 is provided, whose output serves as a condition for opening the gates of the 3-input NAND gates 5-2 and 5-3 when the timing signal T is in the state "0", i.e., the data in the binary counter 2-1 remains unchanged. The timing signal $T_1$ is supplied to the other inputs of the 3-input NAND gates 5-2 and 5-3 and serves as another condition for opening their gates. More specifically, at clearing the binary counter 2-1, the timing signal $T_1$ turns into "0" and hence the 3-input NAND gates 5-2 and 5-3 close their gates. The 4-bit magnitude comparator 5-1 duly performs its comparison operation when the timing signal T is in the state "0", that is, the data in the binary counter 2-1 remains unchanged when the timing signal $T_1$ is in the state "1". An ideal velocity signal corresponding to the rest of the distance to be traveled by the cage is supplied to the A-input, and a signal representing the velocity at which the cage is actually running is supplied to the B-input. The comparator 5-1 compares the two inputs with each other. When A > B, the output of the 3-input NAND gate 5-2 takes on the state "0", thereby setting the output of the 2-input NAND gate 5-4 into "0". When B > A, the output of the 3-input NAND gate 5-3 takes on the state "0", thereby setting the output of the 2-input NAND gate 5-4 into "0". Assume the outputs of the 2-input NAND gates 5-4 and 5-5 are indicated by OUTA and OUTB respectively. Then *OUTA* = "0" and *OUTB* = "1" when A < B, and *OUTA* = "1" and *OUTB* = "0" when A > B.

The reset signal is supplied to the clear terminal of the binary counter 1-2 in order to clear the binary counter 1-2 when the cage 12 stops at a reference floor or any other floor. The manner of applying the reset signal depends on whether the basis for computing the distance traveled by the cage is on an absolute factor or a relative factor.

Figure 4:
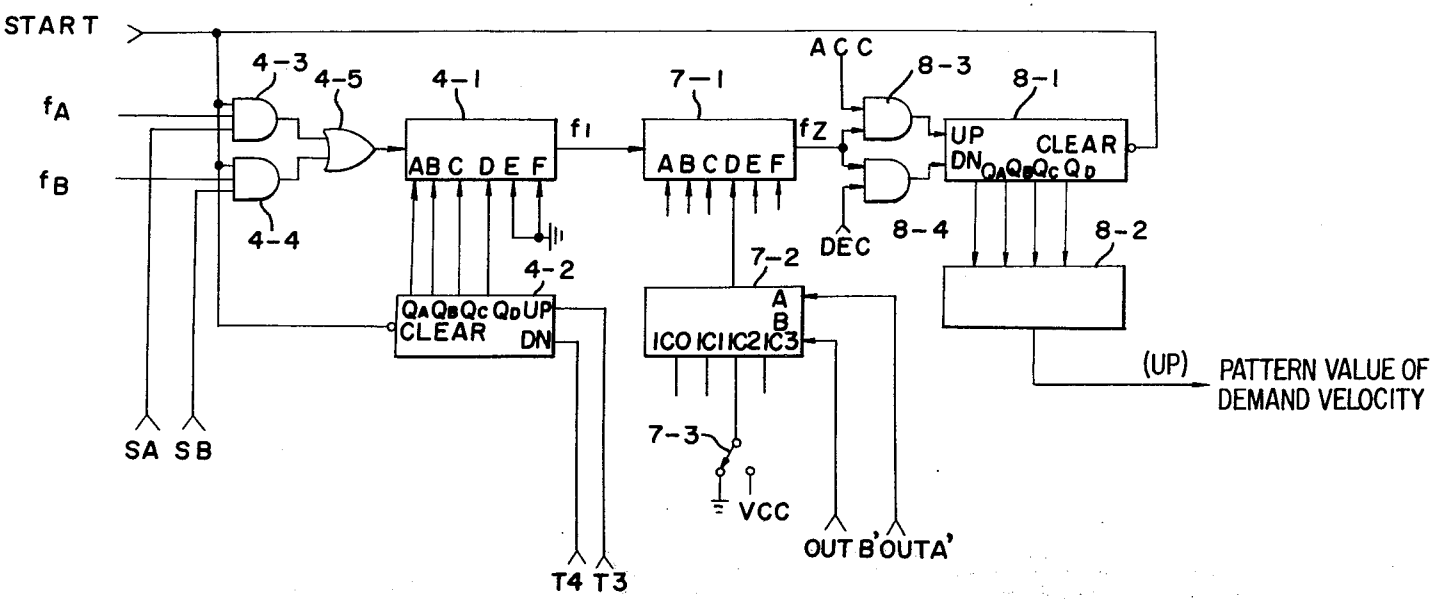

Referring to FIG. 4, a circuit diagram is shown to illustrate in detail the constituent components 4, 7 and 8 of the apparatus shown in FIG. 2, comprising a 6-bit binary rate multiplier 4-1 capable of generating only weighted numbers corresponding to a binary 6-bit (64) pulse input. This multiplier is constituted, for example, of SN7497 of Texas Instruments. Further comprising are a binary counter 4-2 similar to the one 1-2, and 3-input AND gates 4-3 and 4-4, and a 2-input OR gate 4-5. For the sake of simplicity, assume two kinds of acceleration selectable in values $f_A$ and $f_B$ which are given in the form of time-series pulse train supplied from a square wave generator (not shown). A start/stop signal is generated by an operation control element (not shown). This signal takes on "1" at start, or "0" at stop. Acceleration selection signals SA and SB are generated by the position computer 3; the signal SA selects the acceleration $f_A$, and the signal SB selects the acceleration $f_B$. When the start/stop signal is in the state "1", thus causing the signal SA to take on the state "1" for selecting the acceleration $f_A$, the 3-input AND gate 4-3 is opened to allow the signal $f_A$ to go to the 2-input OR gate 4-5, thence to the 6-bit binary rate multiplier. When the signal SB is turned into "1" for selecting the acceleration $f_B$, the 3-input AND gate 4-4 is opened and the signal $f_B$ is supplied as an input to the 6-bit binary rate multiplier 4-1. The purpose of the binary counter 4-2 is to weight for the 6-bit binary rate multiplier 4-1 in such manner that the data in the binary counter is changed with time, thereby changing the weight with time and thus changing the output of the 6-bit binary rate multiplier 4-1 with time. By this operation, the acceleration of the cage in the system as shown in FIG. 1 is duly controlled in relation to time.

Timing signals $T_3$ and $T_4$ are generated by a timing signal generator (not shown); the timing signal $T_3$ is for operation where the acceleration increases in absolute value, and the timing $T_4$ for operation where the acceleration decreases in absolute value. These timing signals are supplied to the binary counter 4-2. While the cage is stopped, the start signal is in the state "0" and hence the clear terminal of the binary counter 4-2 stands at "0". In this state the data in the binary counter 4-2 is cleared. When the start signal takes on the state "1", the timing signal $T_3$ goes to the up-input of the binary counter 4-2. The binary counter 4-2 counts up its data each time the timing signal $T_3$ comes in, and generates the counted data at its outputs $Q_A$, $Q_B$, $Q_C$ and $Q_D$, which are supplied in terms of weight to the 6-bit binary rate multiplier 4-1. The output $f_1$ of the multiplier 4-1 is expressed as follows when it is given an input $f_A$ where the terminals E and F stand at "0".

$$f_1 = \frac{A \cdot 2^0 + B \cdot 2^1 + C \cdot 2^2 + D \cdot 2^3}{64} f_A$$

Accordingly, the output $f_1$ increases by $1/64\, f_A$ at each arrival of the timing signal $T_3$. When the need for decreasing the acceleration occurs, a timing signal $T_4$ comes in the DN input of the binary counter 4-2, causing its data to be counted down. In this manner the acceleration of the cage is changed with time in the system shown in FIG. 1. There is provided a 6-bit rate multiplier 7-1 similar to the one 4-1. Also provided is a data selector 7-2 capable of selecting one of four data formed of inputs supplied to its terminals A and B. The data selector 7-2 is constituted, for example, of SN74153 of Texas Instruments. The 6-bit binary rate multiplier 7-1 has weight inputs A to F as shown in FIG. 4. For the sake of illustration, the input D is shown led from the data selector 7-2. (The other inputs A, B, C, E and F are supposed to have similar connections). The data selector 7-2 has four inputs $IC_0$, $IC_1$, $IC_2$ and $IC_3$, of which the input $IC_2$ is shown connected to a switch 7-3, permitting the selecting data to be preset according as the switch is connected to "0" or "1" side. The same switch is provided for the other inputs $IC_0$, $IC_1$ and $IC_3$, though not shown for the sake of simplicity.

The AND circuit 6 opens its gates at the arrival of a signal of region II from the position computer 3 and generates a signal OUTA' or OUTB' from the signal OUTA or OUTB supplied from the comparator 5. The signal OUTA' or OUTB' is supplied to the data selector 7-2 as a condition for data selection. As described by referring to FIG. 3, when A > B, i.e., the actual cage velocity is smaller than an ideal velocity, the signal OUTA takes on the state "1", and the signal OUTB on the state "0". These states are given as $OUTA' =$ "1" and $OUTB' =$ "0" serving as the condition for data selection by the data selector 7-2. When A < B, i.e., the actual cage velocity is larger than an ideal velocity, the signal OUTB takes on the state "1", and the signal OUTA on the state "0", which are given as $OUTB' =$ "1" and $OUTA' =$ "0" serving as the condition for data selection by the data selector 7-2. In the velocity region I, there is no signal of region II and hence the AND circuit 6 closes its gates whereby $OUTA' = OUTB' =$ "0" is the condition for data selection by the data selector 7-2.

In FIG. 1, the region II is the deceleration region. Thus, when the actual cage velocity is larger than an ideal velocity, the cage must be quickly decelerated in order to cause the cage velocity to approach the ideal velocity. To this effect the negative acceleration must be increased. While, when the actual cage velocity is smaller than an ideal velocity, the deceleration must be reduced in order to cause the cage velocity to approach the ideal velocity. Then the negative acceleration must be reduced. More specifically, assume the data to be selected is of 64 when $OUTA' = OUTB' =$ "0", i.e., in the region I. The relationship between the input $f_1$ and the output $f_2$ of the 6-bit binary rate multiplier may be expressed as $$f_2 = 1/64 \times K \times 64f_1 = Kf_1$$

Further assume that the data to be selected when $OUTA' =$ "0" and $OUTB' =$ "1" is $64K(1 + \alpha)$, and the data to be selected when $OUTA' =$ "1" and $OUTB' =$ "0" is $64K(1 - \alpha)$ where $<<1$. Then, when $OUTA' =$ "0" and $OUTB' =$ "1"

$$f_2 = 1/64 \times K(1 + \alpha) \times 64f_1 = K(1 + \alpha)f_1$$

When $OUTA' =$ "1" and $OUTB' =$ "0"

$$f_2 = 1/64 \times K(1 - \alpha) \times 64f_1 = K(1 - \alpha)f_1$$

Accordingly, the value of $f_2$ in the state $OUTA' = OUTB' =$ "0" can be increased by a factor of $(1 + \alpha)$ and $(1 - \alpha)$ in the state $OUTA' =$ "0" and $OUTB' =$ "1", or $OUTA' =$ "1" and $OUTB' =$ "0". In other words, when the width of the change in the acceleration in the region II of FIG. 1 is $2\alpha$, the acceleration can be adjusted according to the result of comparison between the actual cage velocity and an ideal velocity.

There is provided a binary counter 8-1 similar to the binary counter 1-2. The binary counter 8-1 is capable of counting the output $f_2$ of the 6-bit binary rate multiplier, thereby causing its stored data to express a velocity pattern value; that is, the output $f_2$ is expressed in terms of time-series digital value. In other words, by counting the output $f_2$, the output $f_2$ is digitally integrated, that is, the integration of the acceleration represents the velocity. Also provided is a digital-to-analog converter 8-2 capable of converting a binary digital value into an analog value. This D/A converter is constituted, for example, of DAC-80 of Burr Brown Research. Two-input AND gates 8-3 and 8-4 are provided for controlling whether the acceleration signal $f_2$ is supplied to the up-input or down-input of the binary counter 8-1. The position computer 3 generates signals ACC and DEC so that the signal ACC takes on "1" and DEC on "0" in the region I, and the signal DEC takes on "1" and ACC on "0" in the region II. When the signal ACC is in the state "1", the 2-input AND gate 8-3 opens its gate, causing the acceleration signal $f_2$ to go to the up-input of the binary counter 8-1 and thereby increasing the data in the counter 8-1. As a result, the velocity pattern value increases with time. Then the acceleration $f_2$ decreases to zero by the operations of the binary counter 4-2 and the 6-bit binary rate multiplier. As a result, increment in the cage velocity decreases and the cage velocity becomes constant at the acceleration $f_2 = 0$.

In the region II, the signal DEC takes on "1", causing the 2-input AND gate 8-4 to open its gate. As a result, the acceleration signal $f_2$ goes to the DN-input of the binary counter 8-1 whereby the data in the counter 8-1 decreases and the velocity pattern value decreases with time. In this process, the actual cage velocity is compared with an ideal velocity, and the acceleration data $f_2$ is modified by the operations of the data selector 7-2 and the 6-bit rate multiplier 7-1 to cause the decrement in the velocity pattern value to be changed, thus bringing the actual cage velocity near the ideal velocity. The outputs $Q_A$, $Q_B$, $Q_C$ and $Q_D$ of the binary counter 8-1 are converted into an analog value by the D/A converter 8-2 and supplied as a command velocity pattern Vp to the motor driving device 9.

Figure 5:
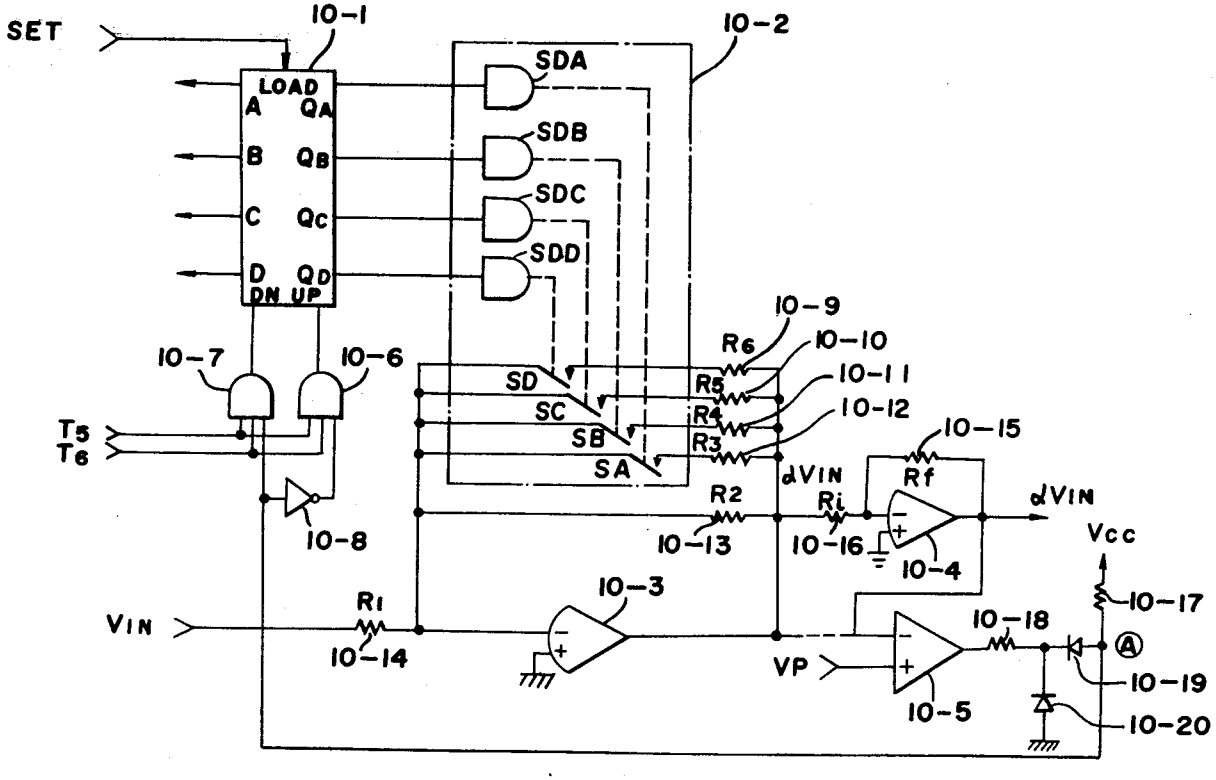

FIG. 5 is a circuit diagram showing in detail the component 10 shown in FIG. 2, which comprises a binary counter 10-1 similar to the binary counter 1-2, having a LOAD terminal and parallel input terminals A, B, C and D for preset. Further comprising is an analog switch 10-2 having semiconductor switches SA to SD and switch drivers SDA to SDD for the individual semiconductor switches. By applying a "1" input to one of the switch drivers, the corresponding semiconductor switch is closed. These semiconductor switches are constituted, for example, of DG201 of Siliconix Incorporated. There are provided operational amplifiers 10-3 and 10-4, each having an inverted input terminal (−) and a noninverted input terminal (+). A feedback resistor Rf is connected between the output terminal and the inverted input terminal, and an input resistor Ri between the inverted input terminal and an input voltage data sorce. Then there is the following relationship between the output and input voltages.

$$\text{Output Voltage} = -R_f/R_i \text{ Input Voltage}$$

When $R_f = R_i$, the output is equal to the input in absolute value and opposite the input in polarity.

There is provided a differential voltage comparator 10-5 having an inverted input terminal (−) and a noninverted input terminal (+). Also provided are 2-input AND gates 10-6 and 10-7, an inverter 10-8, and feedback resistors 10-9 to 10-12, indicated by $R_2$ to $R_6$, used for the operational amplifier 10-3. A resistor 10-14 indicated by $R_1$ is used as an input resistor for the operational amplifier 10-3. A feedback resistor 10-15 indicated by $R_f$ and an input resistor 10-16 indicated by $R_i$ are provided for the operational amplifier 10-4. When $R_f = R_i$, this operational amplifier operates as a polarity inverting amplifier. Further provided are resistors 10-17, 10-18, and diodes 10-19 and 10-20 used for preventing undesirable influence from being caused by the voltage at point Ⓐ upon logical elements. The reference Vcc denotes a power source voltage for logical elements. When the output of the differential voltage comparator 10-5 is larger than the power source voltage Vcc, the reverse current is blocked by a diode 10-19 with its anode side connected to the power source voltage Vcc through the resistor 10-17 and its cathode side connected to the output of the differential voltage comparator 10-5 through the resistor 10-18. As a result, the voltage at point Ⓐ will not exceed the power source voltage Vcc. When the output of the differential voltage comparator 10-5 becomes lower than zero volt, a diode 10-20 having its anode side grounded and its cathode side connected to the output of the differential voltage comparator 10-5 through the resistor 10-18 allows a current to flow into the differential voltage comparator 10-5 from the diode 10-20 via ground and from the power source Vcc via the resistor 10-17 and the diode 10-19. In this operation, because the anode of the diode 10-20 is grounded, the voltage at its cathode does not fall below its forward voltage drop. As a result, the voltage at point Ⓐ is maintained at about zero volt, which prevents logical elements from being undesirably affected.

The function of the feedback resistor for the operational amplifier 10-3 will be described below. When all the semiconductor switches SA to SD are in "OFF" state, only the feedback resistor $R_2$ is in force where the feedback resistance is maximum. When one of the semiconductor switches SA to SD becomes turned on, a resistor is connected in parallel to the resistor $R_2$, causing the feedback resistance to be reduced. When all the switches SA to SD are "ON", the feedback resistance is minimum. Thus, by changing the feedback resistance, the input-output conversion ratio, i.e., the gain, is changed.

Assume $R_6 = 2R_2$, $R_5 = 4R_2$, $R_4 = 8R_2$ and $R_3 = 16R_2$. Then the feedback resistance $R_f$ when all the switches SA to SD are "ON" is given as $$R_f = \frac{1}{\frac{1}{R_2} + \frac{1}{R_3} + \frac{1}{R_4} + \frac{1}{R_5} + \frac{1}{R_6}} = \frac{16}{31} R_2$$

Because the feedback resistance is $R_2$ when the switches SA to SD are all "OFF" as described, the above expression signifies the fact that the gain decreases by a factor of 16/3. Assume the value of the input resistor 10-14 ($R_1$) is determined so that $R_f = (24/31)\ R_2$. Then the output voltage can be varied 31/24 to 16/24 times a given input voltage by the operation of the semiconductor switches SA to SD. The binary counter 10-1 is used to drive the switch SA to SD. The binary counter 10-1 counts up or down its data for a given period of time after the region II is switched to the region III. In the regions I and II, the set signal is in the state "0" and the parallel binary input given to the inputs A, B, C and D is loaded in the binary counter 10-1. In the region III, a timing signal $T_5$ takes on "1" for a given period of time, that is, for the period the output Vin from the position-velocity converter 19 is gain-controlled to the command velocity pattern value and switched by the motor driving device 9, thereby opening the gates of the 3-input AND gates 10-6 and 10-7. A timing signal $T_6$ is a high speed pulse for causing the binary counter 10-1 to count up or down its data. The timing signals $T_5$ and $T_6$ are generated by the individual timing generators. The symbol $V_{IN}$ denotes an output from the position-velocity converter 19, and $V_P$ a command velocity pattern value obtained in the circuit shown in FIG. 4. At transition to the region III from II, the operational amplifier 10-3 generates an output at gain 1, i.e., an output $-V_{IN}$, which appears as an inverted output $V_{IN}$ at the operational amplifier 10-4. This output $V_{IN}$ is supplied to the inverted input terminal of the differential voltage comparator 10-5, and the command velocity pattern signal $V_P$ is supplied to the noninverted input terminal thereof. When $V_{IN} > V_P$ as the result of comparison, the output of the differential voltage comparator 10-5 becomes negative and the voltage at point Ⓐ stands at zero level "0". By this signal the gate of the 3-input AND gate is opened via the inverter 10-8 whereby the timing signal $T_6$ drives the binary counter 10-1 to count up its data. The switches SA to SD are turned on or off according to the data in the counter 10-1 to cause the gain of the operational amplifier 10-4 to be changed, thus controlling the output of $V_{IN}$ to $\alpha V_{IN}$ so that $\alpha V_{IN}$ equals $V_P$. When $V_P > V_{IN}$, the gate of the 3-input AND gate 10-7 is opened to cause the data in the binary counter 10-1 to be counted down. A given time after this operation, the timing signal $T_5$ takes on "0" and the binary counter 10-1 stops counting. At the same time the signal $V_{IN}$ from the position-velocity converter 19 is supplied as $\alpha V_{IN}$ to the motor driving device 9. Thus, switched from $V_P$, the signal $\alpha V_{IN}$ is used as a velocity pattern for the cage to stop at the aimed floor.

In the above embodiment, a cage speed control apparatus in which the acceleration is modified has been described. It is apparent that the invention is applicable to cage speed control apparatus in which the command velocity pattern is generated according to a jerk, which is modified for appropriate cage velocity.

According to the invention, as has been described, the actual cage velocity is compared with an ideal velocity determined according to the distance to be traveled by the cage whereby the command acceleration is adjusted and thus the actual cage velocity is brought near the ideal velocity. The apparatus of the invention therefore minimizes error in landing the cage in position and improves passenger comfort.

What is claimed as new and desired to be secured by Letters patent in the United States is:

1. An elevator speed control apparatus comprising: an ideal velocity generator for generating a velocity ideal for the cage to travel the distance to a floor the cage is to land; a velocity detector for detecting the velocity of the cage in motion; a comparator for comparing the actual cage velocity data supplied from the velocity detector with the ideal velocity data supplied from the ideal velocity generator; an acceleration setting device for setting an acceleration for the cage; an acceleration modifying device operated by the output of the comparator, for modifying the acceleration data supplied from the acceleration setting device; a command velocity pattern generator for integrating with time the acceleration data supplied from the acceleration modifying device and thus generating a command velocity pattern; and a motor driving device for controlling the cage hoist driving motor according to the command velocity pattern; wherein an ideal cage velocity is maintained by modifying the acceleration data according to the output of the comparator.

2. The elevator speed control apparatus according to claim 1 wherein said velocity detector detects an actual cage velocity according to the distance traveled by the cage for a given period of time.

3. The elevator speed control apparatus according to claim 1 wherein said acceleration setting device sets an acceleration for the cage according to an acceleration selection signal supplied from a position computer which selects an acceleration for the cage according to a call generated.

4. The elevator speed control apparatus according to claim 1 further comprising: a position-velocity converter for generating a velocity pattern corresponding to a position immediately before stopping of the cage; and an automatic gain adjusting device supplied with the output of the position-velocity converter; wherein said gain adjusting device is used whereby the output of the position-velocity converter is automatically caused to match with the level of a command velocity pattern at switching from the output of said command velocity pattern generator to the output of said position-velocity converter.

* * * * *